US006516469B1

(12) United States Patent
Schaetzel

(10) Patent No.: US 6,516,469 B1
(45) Date of Patent: Feb. 11, 2003

(54) DIARRHEA MITTEN

(76) Inventor: Mary Alice Schaetzel, 1022 Silver Spruce, Arlington, TX (US) 76017

( * ) Notice: Subject to any disclaimer, the term of this patent is extended or adjusted under 35 U.S.C. 154(b) by 5 days.

(21) Appl. No.: 09/689,973

(22) Filed: Oct. 13, 2000

Related U.S. Application Data

(63) Continuation-in-part of application No. 09/531,416, filed on Mar. 20, 2000.

(51) Int. Cl.[7] ..... A41D 13/08

(52) U.S. Cl. ..... 2/16; 2/158; 2/161.6; 15/227; 119/850

(58) Field of Search ..... 2/16, 20, 158, 2/159, 161.1, 161.6, 163, 167; 15/227; 119/161, 850

(56) References Cited

U.S. PATENT DOCUMENTS 4,677,697 A * 7/1987 Hayes ..... 2/159
4,788,733 A * 12/1988 Lerner ..... 15/104.94
4,845,781 A * 7/1989 Strickland et al. ..... 2/161
4,959,881 A * 10/1990 Murray ..... 15/227
5,301,806 A * 4/1994 Olson ..... 206/278
5,406,649 A * 4/1995 Bolembach ..... 2/158
5,568,955 A * 10/1996 Giuliano et al. ..... 294/1.3
5,649,336 A * 7/1997 Finch et al. ..... 15/104.94
5,704,670 A * 1/1998 Surplus ..... 294/25
5,774,889 A * 7/1998 Gochanour ..... 2/16
5,961,167 A * 10/1999 Gilley ..... 294/1.3
6,058,882 A * 5/2000 Leutholt ..... 119/161
6,250,829 B1 * 6/2001 Brower et al. ..... 401/7

* cited by examiner

*Primary Examiner*—Peter Nerbun
*Assistant Examiner*—Katherine Moran
(74) *Attorney, Agent, or Firm*—George L. Williamson

(57) ABSTRACT

The present invention discloses a sanitary handwear being a hygienic mitten to be worn about the hand of the user for protection of the hand of the user to be used to clean, wipe babies, self, or older people with bowel control problems. The present invention has a single compartment to house all of the fingers of the hand and a separate compartment for the thumb and has a defined wrist area. The mitten of the present invention is made of two layers. The first, inner layer is waterproof and impermeable, and, the second, outer layer is a moist, extra absorbent cloth-like disposable material containing moisturizers. The mitten is comprised of disposable material so that it may be easily and economically disposed of after use. The mitten also has an internal pull tab to aid in removal of the glove from the hand of the user.

10 Claims, 1 Drawing Sheet

DIARRHEA MITTEN

PRIOR APPLICATION INFORMATION

This application is a continuation-in-part of application Ser. No. 09/531,416 filed Mar. 20, 2000.

BACKGROUND OF THE INVENTION

1. Field of the Invention

The present invention relates generally to the field of hand protection, more particularly, to protective hygienic mittens to be worn by a user to protect his hands from human waste material as the user performs hygienic care of the body of a baby, older person or self.

2. Description of the Prior Art

Protective handwear has been described in the prior art. However, none of the prior art devices disclose the unique features of the present invention.

In U.S. Pat. No. 5,732,413, dated Mar. 31, 1998, Williams disclosed an article of clothing and the method of making the same which will allow water vapor due to perspiration to transpire through the article but will prevent liquid water from external sources from reaching the wearer's extremity. One form of the article of the invention comprises a sock which is of three-ply construction with the inside and outside plies being knit and the intermediate ply being made from a stretch and return polyurethane film. The three plies are uniquely bonded together using a pliant, waterproof adhesive. Another form of the mandrel comprises a glove which is of a similar three-ply construction.

In U.S. Pat. No. 5,673,435, dated October 7, 1997, Gebhard disclosed a cleaning glove specifically adaptable for bathing infants and made up of a single layer of fine terry cloth material to define the palmar, back, finger and thumb portions together with an elastic cuffjoined to said palmar and back portions to define a wrist portion, the cuff being ribbed and sized to prevent accidental removal of the glove from the hand when wet.

In U.S. Pat. No. 5,740,554, dated Apr. 21, 1998, Reed disclosed an invention comprising a mitten device for sanitarily removing a tampon from a body cavity of an individual and thereafter disposing of the tampon through the solid waste system as opposed to the plumbing system. The mitten is adapted to fit over a hand and wrist and has a front side and a back side. The mitten has a unitary finger portion, a partially detached index finger portion, a thumb portion, a mid-section, a cuff portion, an absorbent pad affixed to the mid-section on the front side of the mitten, and an adhesive tab. The unitary finger portion includes a grasping portion on the front side of the middle finger near the fingertip. In use the mitten is utilized to remove the tampon for disposal from an individual's body. The individual then makes a fist around the tampon. The mitten is then inverted and rolled and secured with the adhesive tab, thereby encasing the tampon within the mitten for sanitary, compact disposal.

In U.S. Pat. No. 5,636,382, dated Jun. 10, 1997, Chopko, et al., disclosed a protective glove system having at least two components including a waterproof and water permeable inner glove component that provides a barrier against allergens and an outer glove component that is liquid proof A method of using the glove system is also provided. Protective shoe systems, body suits, and headgear systems are also provided.

In U.S. Pat. No. 5,780,043 dated Jul. 14, 1998, Dane, et al., disclosed an invention relating to infection resistant polyurethane having the infection resistant agents incorporated into the matrix of the thermoplastic polyurethane resin. This agent acts as a pool of infection resistant material. This infection resistant material can be used to make gloves and condoms.

Other related art includes U.S. Pat. No. 5,406,649 dated April 1995 to Bolembach While these hand wear devices may be suitable for the purposes to which they were designed, they would not be as suitable for the purposes of the present invention, as hereinafter described.

SUMMARY OF THE INVENTION

The present invention discloses a protective handwear device being a hygienic mitten to be worn about the hand of the user for protection of the hand while the user is cleaning babies, older people, or self with bowel control problems. The present invention has a single compartment to house all of the fingers of the hand and a separate compartment for the thumb. The mitten of the present invention is made of two layers. The first, inner layer is waterproof and impermeable, and, the second, outer layer is a moist, extra absorbent cloth-like disposable material containing moisturizers. The mitten is comprised of disposable material so that it may be easily and economically disposed of after use. The mitten also has an internal pull tab to aid in the removal of the mitten from the hand of the user.

An object of the present invention is to provide a cover or protective surface to the hand of the user in order to prevent bacterial are other microbial infection to be transmitted to the user. Another object of the present invention is to provide a means to keep the hands of the user clean.

An object of the present invention is to provide a mitten to be worn about the hand which mitten can be easily placed upon and removed from the hand of the user. Another object of the present invention is to provide an economical means to keep the hands of the user clean. A further object of the present invention is to provide a mitten which is economical to manufacture so that it can be easily disposed of without great expense to the user.

The foregoing and other objects and advantages of the present invention will appear from the description to follow. In the description reference is made to the accompanying drawing, which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
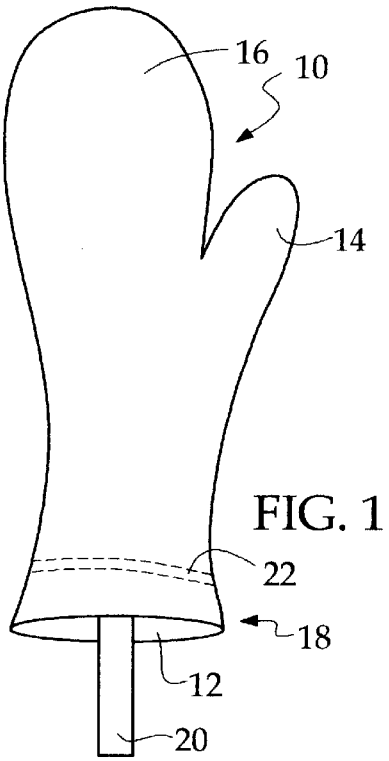
FIG. 1 is a perspective view of the present invention.

With regard to the reference numerals used, the following numbering is used.

10 present invention
12 opening
14 thumb compartment
16 finger compartment
18 wrist area
20 pull tab
22 elastic
24 sewn area
26 knot

DESCRIPTION OF THE PREFERRED EMBODIMENT(S)

Figure 2:
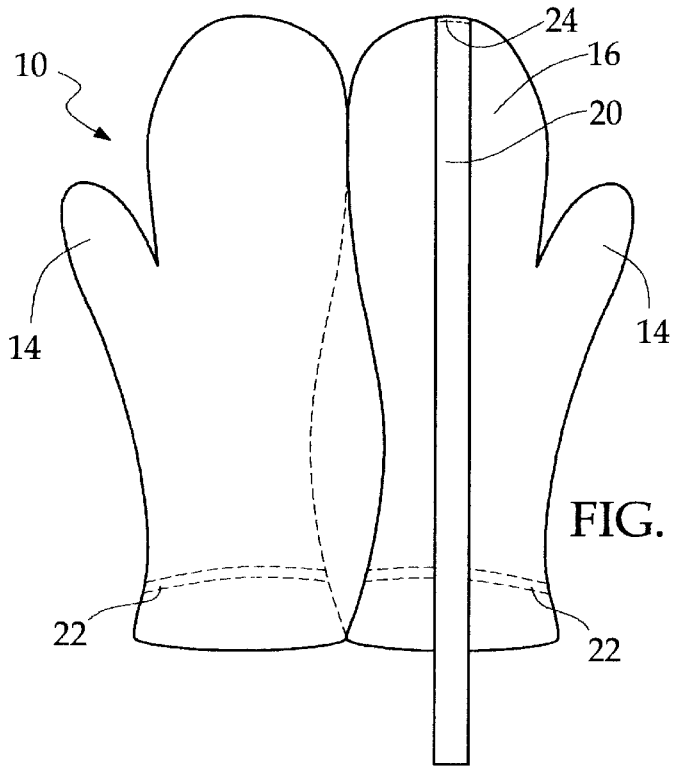
FIG. 2 is a cut-away view showing the inside of the present invention.
Figure 3:
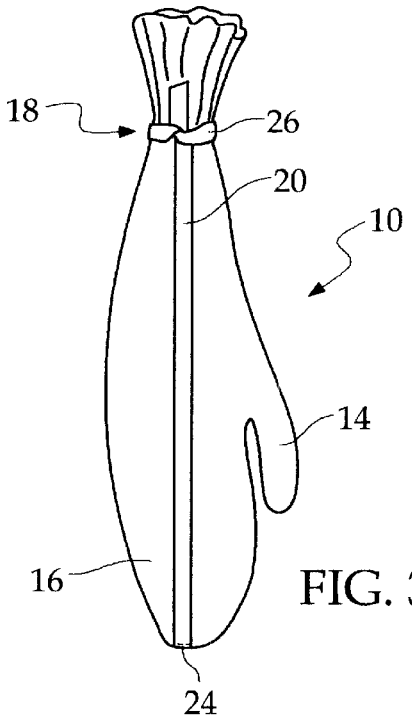
FIG. 3 is a perspective view of the present invention inverted.

Turning now descriptively to the drawings, FIGS. 1 to 3 illustrate the present invention being a sanitary mitten to be worn by a user for hygienic purposes.

Turning to FIG. 1, therein is shown a perspective view of one embodiment of the present invention generally shown at 10. Shown therein is a mitten 10 which entirely covers and encloses the hand of the user by having the user insert his hand through the opening 12 located at the defined wrist area 18 of the present invention 10. The user would then pull the mitten 10 entirely over his hand so that the thumb compartment 14 of the mitten covers the thumb of the user and the fingers of the user would then be located in the area generally shown at 16. The mitten 10 of the present invention is simply designed so that it can be economically and inexpensively manufactured in order that it may be disposable. Note that the mitten 10 fits entirely over the hand of the user and covers all surfaces of the hand of the user from the fingertips to the wrist area of the user. The mitten can be made of many types of material including plastic, rubber, or other waterproof/impermeable or like pliable type of material and elastomeric material 22 may be used in the wrist area 18. Also shown is pull-tab or string 20 which provides for easier removal of the glove 10 containing fecal matter. The pull-tab 20 is made of strong material so that it will not tear when it is pulled and is attached by stitching to the mitten end of the glove and the stitching is reinforced for strength. The pull-tab 20 will aid in inverting the glove and is used to tie and seal the glove at the wrist area in order to reduce odor. Also shown is an elastic band 22 which acts as a seal to the mitten on the arm of the user.

The mitten 10 is intended to be used to protect the hand of the user as it contacts human waste material as the user performs hygienic care of the body of a baby or older person who has bowel control problems.

Turning to FIG. 2, therein is shown a glove cut open showing the inside of the mitten 10 along with a pull-tab 20. Shown is the inside of the first, inner layer or liner which is made of waterproof, anti-bacterial material to prevent bacterial or other microbial infections from being transmitted to the user. The second, outer layer is a moist, thin, extra-absorbent, cloth-like disposable material with moisturizers added thereto in order to moisturize the material and mask the odor of fecal matter. Also note that the outer layer should be moist somewhat like a baby wipe but thicker. Also note that the pull-tab has a sewn area 24 for reinforcement and attachment to end of the finger compartment 16 of the present invention 10.

Turning to FIG. 3, therein is shown the present invention 10 inverted, i.e., turned inside out, along with elements previously disclosed showing the pull tab 20 tied in a knot 26 about the wrist area 18 of the present invention 10 wherein the present invention acts somewhat like a bag for containing the fecal material or like material.

What is claimed to be new and desired to be protected by Letters Patent is set forth in the appended claims:

1. A hygienic mitten to be worn on the hand of the user, comprising:

a) a first portion of the mitten for receiving the fingers of the hand of the user;

b) said first portion of the mitten sized to receive the fingers of the hand of the user;

c) a second portion of the mitten for receiving the thumb of the hand of the user;

d) said second portion of the mitten sized to receive the thumb of the hand of the user;

e) a third portion of the mitten, said third portion having a defined wrist area;

f) said third portion of the mitten sized to receive the wrist of the hand of the user;

g) said third portion of the mitten having an opening therein for receiving the hand, the thumb, and the wrist of the user;

h) wherein said first portion, said second portion, and said third portion further comprise a first, inner layer;

i) wherein said first portion, said second portion, and said third portion further comprise a second, outer layer;

j) a pull tab disposed internal the mitten to aid in removing the mitten from the hand of the user, said pull tab extending through said third portion of said mitten; and, k) said pull tab having means for attachment to said first portion of the mitten to aid in removing the apparatus from the hand of the user.

2. The apparatus of claim 1, wherein said first layer comprises pliable waterproof material.

3. The apparatus of claim 1, wherein said first layer comprises antibacterial material.

4. The apparatus of claim 1, wherein said second layer comprises absorbent cloth-like material.

5. The apparatus of claim 1, wherein said second layer comprises moisturizers.

6. The apparatus of claim 1, wherein said third portion of the mitten is made of elastomeric material.

7. The apparatus of claim 1, said third portion of the mitten further comprises elastic means whereby said third portion of the mitten tightly seals against the wrist and hygienically protects the hand of the user.

8. The apparatus of claim 1, said opening of the mitten further comprises elastic means whereby said opening of the mitten tightly seals against the wrist and hygienically protects the hand of the user.

9. The apparatus of claims 1 said means for attachment further comprising sewing said pull tab to said first portion of the apparatus to aid in removing the apparatus from the hand of the user.

10. The apparatus of claim 9, wherein said pull tab may be tied in a knot about said third portion of the apparatus when the apparatus is turned inside out.

* * * * *